US010543697B2

(12) United States Patent
Preckel et al.

(10) Patent No.: US 10,543,697 B2
(45) Date of Patent: Jan. 28, 2020

(54) METHOD AND DEVICE FOR THE PRINTING OF CONTAINERS

(71) Applicant: KHS GmbH, Dortmund (DE)

(72) Inventors: Katrin Preckel, Gelsenkirchen (DE); Alexandra Theopold, Dortmund (DE)

(73) Assignee: KHS GmbH, Dortmund (DE)

( * ) Notice: Subject to any disclaimer, the term of this patent is extended or adjusted under 35 U.S.C. 154(b) by 626 days.

(21) Appl. No.: 15/175,352

(22) Filed: Jun. 7, 2016

(65) Prior Publication Data

US 2017/0348981 A1 Dec. 7, 2017

(51) Int. Cl.

| | |
|---|---|
| ***B41J 3/407*** | (2006.01) |
| ***B41J 2/01*** | (2006.01) |
| ***B44F 1/04*** | (2006.01) |
| *B41M 5/00* | (2006.01) |
| *B41M 3/00* | (2006.01) |

(52) U.S. Cl.

CPC ..... *B41J 3/4073* (2013.01); *B41J 2/01* (2013.01); *B44F 1/045* (2013.01); *B41M 3/008* (2013.01); *B41M 5/0047* (2013.01); *B41M 5/0082* (2013.01); *B41M 5/0088* (2013.01)

(58) Field of Classification Search

None

See application file for complete search history.

(56) References Cited

U.S. PATENT DOCUMENTS

| | | | | |
|---|---|---|---|---|
| 7,104,643 | B2 * | 9/2006 | Glass | B41J 3/4073 347/100 |
| 7,703,226 | B2 * | 4/2010 | Schnuckle | B65D 23/085 359/439 |
| 2014/0313247 | A1 * | 10/2014 | Preckel | B41J 3/4073 347/4 |
| 2015/0085006 | A1 * | 3/2015 | Nick | B41F 17/28 347/12 |

* cited by examiner

*Primary Examiner* — Benjamin A Schiffman

(74) *Attorney, Agent, or Firm* — Occhiuti & Rohlicek LLP

(57) ABSTRACT

A method for printing on at least partially transparent containers, wherein, in a first printing step, a first printing image is printed onto the container by the application of at least one printing ink, and wherein, in a second printing step, a second printing image is printed onto the container by the application of at least one printing ink, wherein the printing images are printed at least partially covering one another, and specifically in such a way that ink layers are applied in a temporal offset sequence onto the container, wherein a first ink layer is allocated to the first printing image and a second ink layer is allocated to the second printing image, and that between the first and second printing image a reflection layer is at least partially provided, by means of which the printing images are at least partially optically separated from one another.

18 Claims, 8 Drawing Sheets

METHOD AND DEVICE FOR THE PRINTING OF CONTAINERS

FIELD OF INVENTION

The invention relates to a method and device for the printing of containers with a print image arrangement consisting of two print images and printing onto a container, comprising a print image arrangement consisting of two print images.

BACKGROUND

The printing on both sides of flat substrates, for example, of paper, also referred to as duplex printing, is known. In this situation, the substrate is printed on two mutually opposed sides.

The principle is further known of printing three-dimensional objects, in particular containers, in particular with a printing method in accordance with the ink-jet principle.

With three-dimensional containers the problem arises that the wall can only be printed on one side, since the second side of the wall faces towards the interior of the container, and delimits this on the circumference side. Printing on both sides of the container wall would be desirable, however, since either after the emptying of the container with non-transparent contents or, with transparent contents, also with the filled container, the inner side of the container wall could be used for the application of a design element and/or information.

SUMMARY

Against the above backdrop, the object of the invention is to provide a method for the printing of containers that will allow for a printing image to be provided on the container in such a way that it is visible on the inner side of the container wall.

According to a first aspect, the invention relates to a method for the printing of at least partially transparent containers. In a first printing step, a first printing image is printed onto the container by the application of at least one printing ink. In a second printing step, which follows the first printing step in a temporal offset sequence, a second printing image is printed onto the container by the application of at least one printing ink. The printing images are in this situation printed at least partially overlapping, i.e. printed on the same area of the container wall. Between the first and second printing image, a reflection layer is at least partially provided, by means of which the printing images can at least partially be optically separated from one another. In other words, therefore, two printing images are applied onto the container wall at sequential time intervals, and specifically in a sandwiched manner, wherein the reflection layer is provided in an intermediate layer between the first and second printing image. The reflection layer can in particular have a reflecting effect for light in the visible range. "Partial" in the meaning of the invention means in this situation that the reflection layer in is not provided full-surface in a first printing image region and in a second printing image region, or that the reflection layer is formed from a plurality of printing pixels, which at least in part do not overlap.

The essential advantage of the method according to the invention lies in the fact that a first printing image is produced, that, when viewed from the rear side of the container through the container wall and the container interior, can be identified, and, in addition to this, a second printing image, which is provided at least partially overlapping the first printing image, can be identified when the container is viewed from the front side. The provision of a reflection layer has the decisive advantage that an optical separation layer is obtained between the printing images arranged above one another, by means of which a clear optical separation is achieved between the first and second printing image, which also increases the contrast sharpness of the colors of the respective printing images. Preferably, the first and second printing images are printing images which are identifiably different from one another, i.e. the first and second printing images can have the same or different image contents.

According to one embodiment, the first and second printing images comprise in each case at least two different printing inks. The printing inks of the individual printing images can in this situation be the same or different. In particular, the first and second printing images can be composed of a set of four printing inks, for example the inks Black, Magenta, Cyan and Yellow. Due to the multilayer overlaid arrangement of different printing inks, multicolored first and second printing images can be formed.

According to one embodiment, the printing inks of the first printing image are applied in the inverse sequence to the printing inks of the second printing image. As has already been indicated, the first printing image can be perceived by an observer from a view from the rear side, and the second printing image from a view from the front side, i.e. the directions of observation are opposed or essentially opposed. In order to take account of these different observation directions, it is advantageous for the printing inks of the printing images to be provided inverted to one another, such that, depending on the direction of observation, in each case the same layering sequence of the printing inks of the printing images is produced. As an alternative, however, it is also possible for the printing inks of the first printing image to be applied in a different sequence to the printing inks of the second printing image (for example, only partially inverted or partially exchanged). As a further alternative it is also conceivable for the printing inks of the first and second printing images to be applied in exactly the same sequence.

According to one embodiment, the first printing image is of the same content as the second printing image, and is applied congruent to this. Accordingly, the motif which is identifiable from the outside can also be identified by an observer when observed from the rear side through the container wall and the container interior.

According to one embodiment, the reflection layer is formed by printing on a printing ink. In particular, this can be a white, light grey, silver, or gold colored printing ink. The printing ink can, in particular, contain titanium dioxide ($TiO2$), for example, titanium dioxide nanoparticles. In addition, the reflection layer can comprise different degrees of coverage, for example one degree of coverage. As a result, the reflection layer can be applied with the printing means, in particular with the digital printing heads operating in accordance with the ink-jet principle.

According to one embodiment, the reflection layer is formed partially or full surface between the first and second printing image. In the situation in which the reflection layer is only partially formed, a partially translucent printing image arrangement is created. Depending on the configuration of the reflection layer, it is therefore possible for different optical effects of the printing image arrangement to be formed, such as, for example, first and second printing images which are fully separated from one another, partially separated first and second printing images, or an entirely translucent printing image arrangement. As a result, the freedom of conceptual arrangement of the printing image arrangement provided on the container can be increased. As an alternative or in addition, it is possible for the reflection layer to be provided such that it is only partially covering, for example with a surface covering of less than 100% (e.g. 50%). This is possible, for example, by a lesser overlapping of adjacent print pixels, such that the reflection layer appears brighter.

According to one embodiment, the reflection layer is non-transparent or essentially non-transparent, and therefore forms an optical separation layer between the first and second printing image. As a result, entirely different information can be appraised by an observer from the different observation directions; for example, with a view from the front side of the container, a label-type printing image can be seen, and, when viewed from the rear side of the container, for example, a prize winning code, an item of text information, or the like.

According to one embodiment, in addition to the first and second printing image, a third printing image is printed onto the container, and specifically onto a container wall region, which, relative to the container height axis, lies opposite the first and second printing image. As a result of this, an image overlay of the first printing image (the printing image provided between the container wall and reflection layer) with the third printing image can be achieved. This takes place, for example, in such a way that, when the third printing image is viewed, the first printing image can be identified through the container walls and into the container interior, and this first printing image therefore appears as a background of the first printing image. As a result, an optically attractive image overlay can be achieved.

According to one embodiment, the printing takes place by digital direct printing, by means of digital printing heads. As a result, a high grade flexible container printing can be obtained, with different information, in particular also in small series.

According to a further aspect, the invention relates to a device for the printing of containers with at least one print station. The print station comprises printing means for the application of a printing image, for example one or more digital printing heads operating in accordance with the ink-jet principle. The printing device is in this situation configured in such a way as to print, in a first printing step, a first printing image, by applying at least one printing ink onto the container, and specifically directly onto its container wall. Furthermore, the printing device is configured such that, in a second printing step, a second printing image is printed onto the container by the application of at least one printing ink onto the container, such that the first and second printing image come to lie at least partially above one another. The printing device is further configured such as to apply, between the first and second printing image, at least partially, a reflection layer, by means of which the printing images are at least partially optically separated from one another.

The major advantage of this device is that, when the container is viewed from different sides, same or different printing images can be identified. Moreover, an optical overlaying of printing images can take place, which are arranged on mutually opposing sides of the container, and of which a printing image arranged between the container wall and the reflection layer can be identified through the container walls and the container interior, as a background image of a third printing image. As a result, the scope for conceptual design at the printing of containers can be further increased.

According to one embodiment, means are provided for the application of a reflection layer, and these means for the application of a reflection layer are formed by a printing head which is configured for the application of a printing ink which forms the reflection layer. As a result, the reflection layer can be applied between the first and second printing image by a printing ink application by means of a digital direct print.

According to one embodiment, the device comprises a plurality of transport elements, which can be driven such as to rotate about an axis of rotation, which in each case comprise printing means for the application of a printing ink. For the application in a temporal sequence of the same printing inks, in each case two transport elements are provided, spaced at a distance from one another in the transport direction, with which in each case the same printing ink is applied. As an alternative, the transport elements with the respective printing inks run through several times. In other words, the ink layers of the same printing ink, which are applied at staggered time intervals in relation to one another, are applied either by two transport elements separated from one another, which are spaced at a distance from one another, or the printing device is run through at least twice for the application of the printing images, wherein, in a first run, the first printing image is applied, and in a second run the second printing image is applied at least partially over the first printing image.

According to a last aspect, the invention relates to a transparent container, comprising a printing image arrangement which is printed directly onto a container wall, wherein the printing image arrangement comprises a first printing image and a second printing image, wherein the printing images are arranged at least partially covering one another, and wherein, between the first and second printing images, at least partially a reflection layer is provided, by means of which the printing images are at least partially separated from one another.

The term "container" in the meaning of the invention is understood to mean all packing means, in particular bottles, cans, bag packing, upright bags, etc.

The term "printing ink" in the meaning of the invention is understood to mean an ink or dye, which in particular is suitable for a digital printing head working in accordance with the ink-jet principle for the printing of containers, in particular plastic containers.

The expression "essentially" or "approximately" in the meaning of the invention signifies deviations from the respective exact value by +/−10%, preferably by +/−5%, and/or deviations in the form of changes which are not of significance for the function.

Further embodiments, advantages, and possible applications of the invention are derived from the following description of exemplary embodiments and from the figures. In this context, all the features described and/or represented in images are in principle the object of the invention, alone or in any desired combination, regardless of their relationship in the claims or reference to them. The contents of the claims are likewise established as constituent parts of the description.

The invention is explained in greater detail hereinafter on the basis of the figures. These show:

DETAILED DESCRIPTION

Figure 1A:
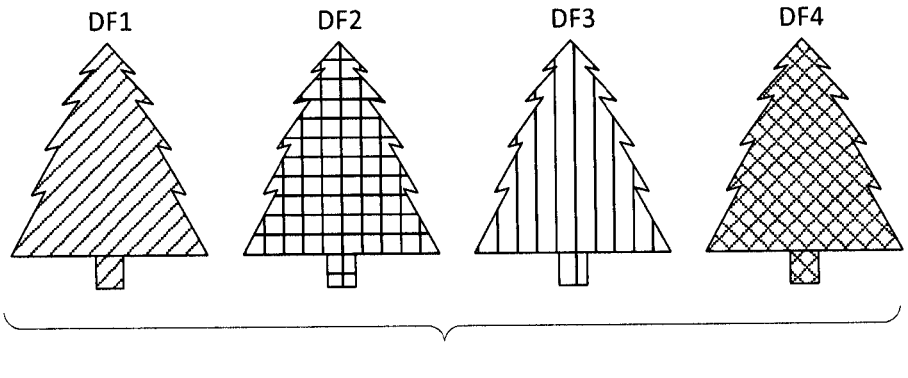
FIG. 1*a* is a schematic representation of a plurality of ink layers with different printing inks of a first printing image.
Figure 1B:
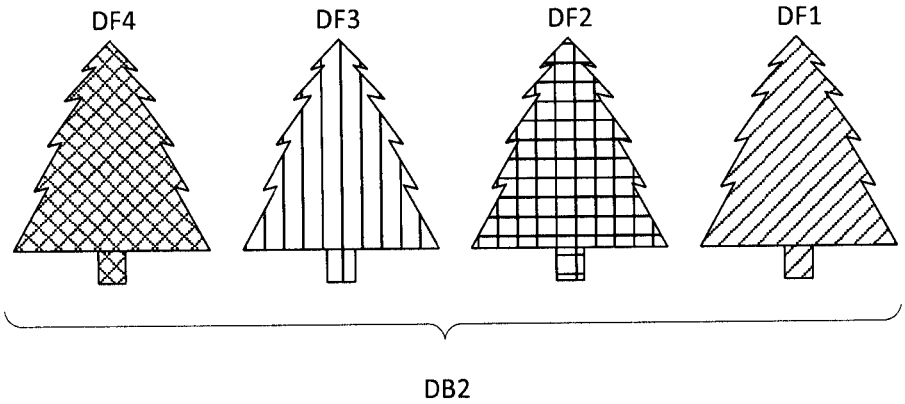
FIG. 1*b* is a schematic representation a plurality of ink layers with different printing inks of a second printing image.
Figure 1C:
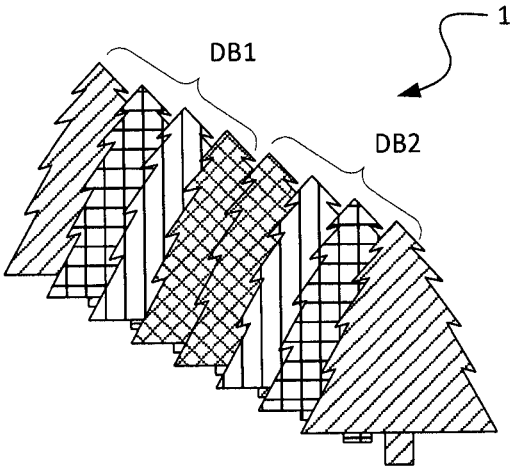
FIG. 1*c* is a schematic representation a printing image arrangement formed by an arrangement of the ink layers from FIGS. 1*a* and 1*b* above one another.

FIGS. 1*a*, 1*b* and 1*c* illustrate, by way of example, the structure of a printing image arrangement 1 according to a first exemplary embodiment. The printing image arrangement 1 comprises, in the exemplary embodiment shown, a first and second printing image DB1, DB2. These printing images DB1, DB2 can be printed onto a wall region of a container 10 in such a way that the first printing image DB1 partially or fully overlaps with the second printing image DB2. In this situation, for example, the first printing image DB1 can be applied directly onto the container wall, and the second printing image DB2 is applied at least partially onto the first printing image DB1.

To obtain a multicolored printing image, a plurality of ink layers of different printing inks DF1, DF2, DF3,DF4 are arranged above one another. The respective printing inks DF1-DF4 are applied in an ink layer in droplet form, wherein the ink layer can be formed continuously, or with an application of the respective printing ink only region by region, such that ink layers lying underneath in regions in which no ink application takes place remain visible. It is likewise possible for the printing inks DF1-DF4 to be applied in such a way that, by mixing the printing inks DF1-DF4 lying on top of one another, a desired color tone is produced. For example, use can be made as printing inks DF1-DF4 of the colors black, magenta, cyan and yellow. As an alternative, the use of other color sets is also possible, for example even only a single color print. In the figures, the different hatchings relate in each case to a printing ink DF1-DF4.

As shown in FIGS. 1*a* and 1*b*, for example, a motif (fir tree) of the printing image DB1 is formed from the ink layers of the printing inks DF1-DF4. The motif of the second printing image DB2 can likewise be formed from ink layers of the printing inks DF1-DF4. In this situation it may be noted that the motif of the first printing image DB1 can be the same as the motif of the second printing image DB2 or different, and also the printing inks used in the printing image DB1 can be the same or different to the printing inks used in the printing image DB2. For example, the printing image DB1 can be a single color printing image, for example a prize winning code, while by contrast the printing image DB2 can be a multicolored printing image. In other words, it is not necessary for each printing image to comprise all the printing inks DF1-DF4, but instead they can be formed from only one reduced printing ink set, or from a single printing ink.

As shown in FIG. 1*c*, the printing images are applied temporally one after another, and at least partially overlapping, and, specifically, first the ink layers allocated to the printing image DB1 and then the ink layers allocated to the printing image DB2. The representation in FIG. 1*c* is selected in such a way that the hatchings allocated to the respective printing inks DF1-DF4 remain identifiable.

Preferably, the arrangement of the ink layers of different printing inks DF1-DF4 in the printing images DB1 and DB2 can be selected inverted to one another, i.e. the printing inks DF1-DF4 of the printing image DB1 are arranged in the reverse sequence to the printing inks DF1-DF4 of the printing image DB2. It can therefore be seen in FIG. 1*c*, for example, that the ink layers of the printing ink DF4 (diagonal checks) come to lie directly above one another, while by contrast the ink layers of the printing ink DF1 (oblique hatching) are arranged spaced at the widest possible distance from one another.

Figure 2:
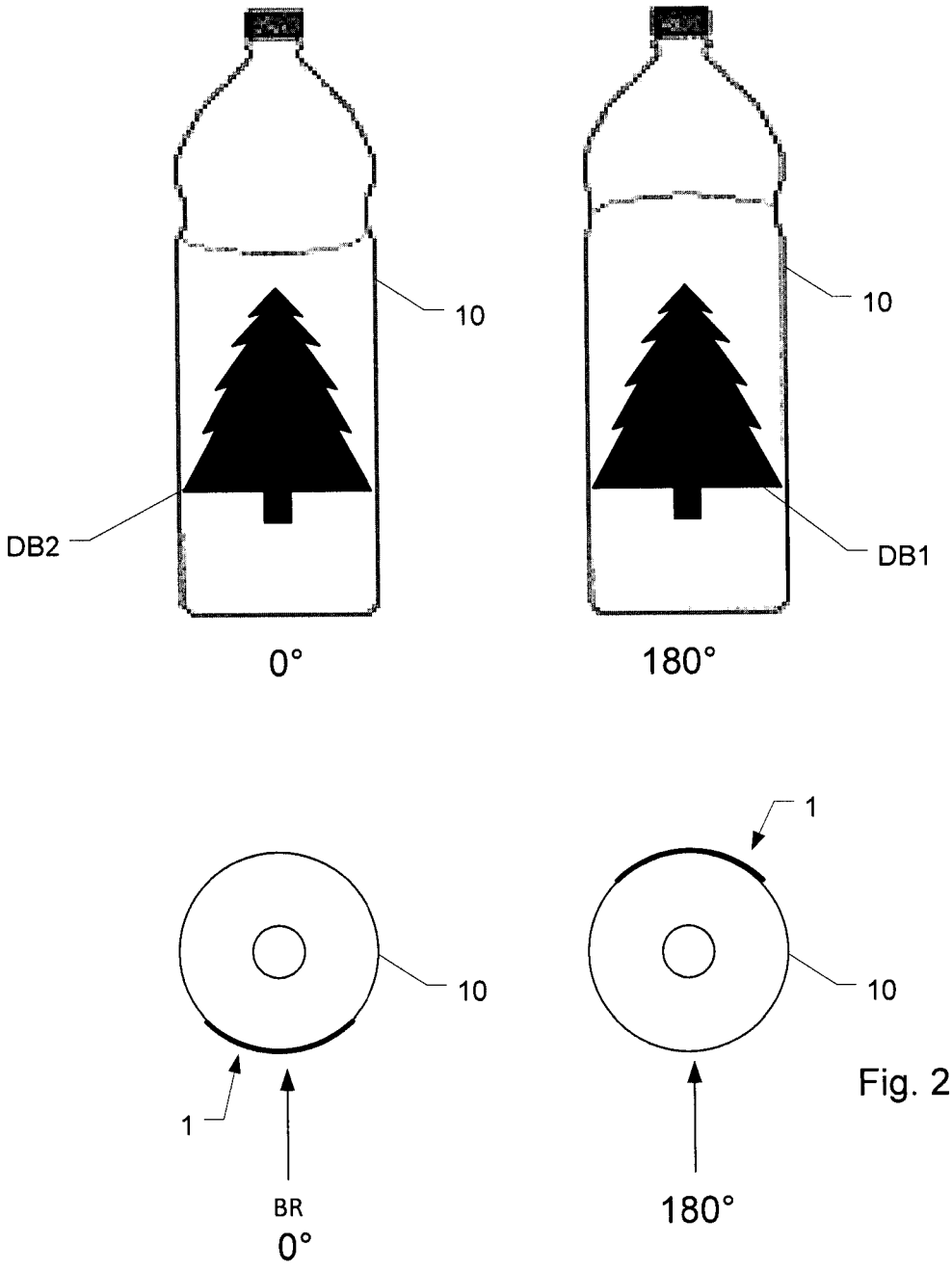
FIG. 2 is a view from above of a plurality of representations of a container printed with a printing image arrangement in accordance with FIG. 1*c*, wherein the upper representation row shows the container in a side view in different rotation positions (left: View from the front side, right: View from the rear side), and the lower representation row shows the container in these rotation positions.

FIG. 2 shows a container 10, on which a printing image arrangement 1 is provided, described heretofore in connection with FIGS. 1*a* to 1*c*. The left upper representation in FIG. 2 shows a container in a front side view onto the printing image arrangement 1, while the right upper representation in FIG. 2 shows a container 10 in a view from the rear side onto the printing image arrangement 1, i.e. the printing image arrangement 1 is appraised through a first transparent container wall, the container interior, and a second transparent container wall. The lower representations in FIG. 2 show in each case views from above of the respective container 10, with the printing image arrangement 1 printed onto it, wherein the lower left representation is allocated to the upper left representation, and the lower right representation is allocated to the upper right representation. In other words, the representations in the left-hand column therefore show the container 10 in a first orientation, and the representations in the right-hand column show the container 10 in a second orientation, rotated through 180° (about the container height axis) to the first orientation. As can be seen by the arrows indicating the direction of view BR, the appraisal of the printing image arrangement 1 in the container representations of the right-hand column is from the rear side, through the container walls and, as applicable, through a filling product that may be present. The printing image arrangement 1 described heretofore allows for the first printing image DB1 to be a printing image that can be appraised independently of the second printing image DB2, and specifically in such a way that the first printing image DB1 can be seen when viewed from the rear side through the transparent container wall and through the container interior, and the second printing image DB2 can be seen viewed from the front side onto the container 10. Preferably, the printing image arrangement 1 described forms a translucent printing image, i.e. the printing image is at least partially light permeable.

FIGS. 3*a* to 3*d* show a further exemplary embodiment of a printing image arrangement 1. Hereafter only the differences will be described in relation to the exemplary embodiment shown in FIGS. 1*a*-1*c*. Apart from this, the explanations apply as given heretofore in connection with the exemplary embodiment according to FIGS. 1*a*-1*c*.

The printing image arrangement 1 comprises in turn a first and second printing image DB1, DB2. These printing images DB1, DB2 can in turn be printed in such a way onto a wall region of a container 10 that the first printing image DB1 covers the second printing image DB2 partially or fully. In this situation, for example, the first printing image DB1 can be applied directly onto the container wall, and the second printing image DB2 is applied at least partially onto the first printing image DB1. As described heretofore, the printing images DB1, DB2 comprise in each case a plurality of ink layers of different printing inks DF1-DF4. The major difference with regard to the exemplary embodiment according to FIGS. 3*a* to 3*d* in relation to the exemplary embodiment according to FIGS. 1*a* to 1*c* is that between the printing images DB1, DB2, arranged at least partially above one another, a reflection layer RFLX is provided. In other words, the reflection layer RFLX forms an intermediate layer or separation layer between the first printing image DB1 and the second printing image DB2.

The reflection layer RFLX is preferably formed by the application of a printing ink. Preferably, the reflection layer RFLX is formed by a white printing ink or light grey, silver, or gold-colored printing ink. Such printing inks exhibit high optical reflection properties, and therefore have the effect of an optical separation between the first printing image DB1 and the second printing image DB2. For example, the reflection layer RFLX can be formed by a printing ink containing titanium dioxide, in particular printing ink containing $TiO_2$ nanoparticles.

Figure 3A:
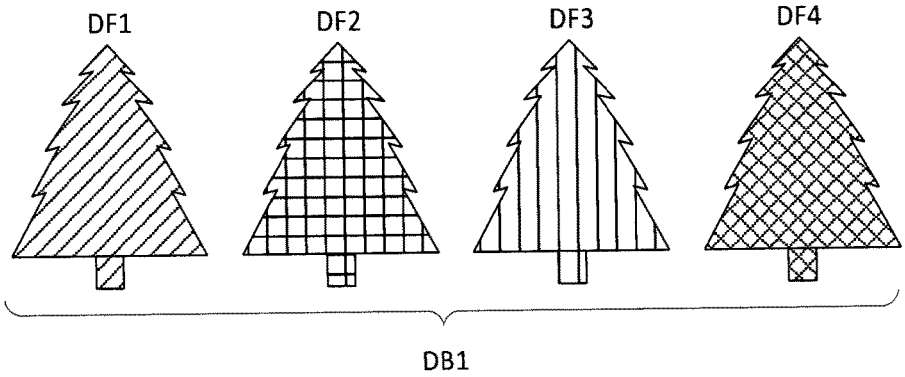
FIG. 3*a* is a schematic representation a plurality of ink layers with different printing inks of a first printing image.
Figure 3B:
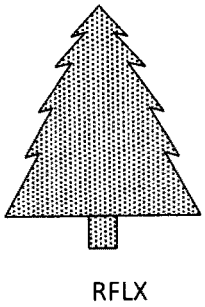
FIG. 3*b* is a schematic representation a reflection layer.
Figure 3C:
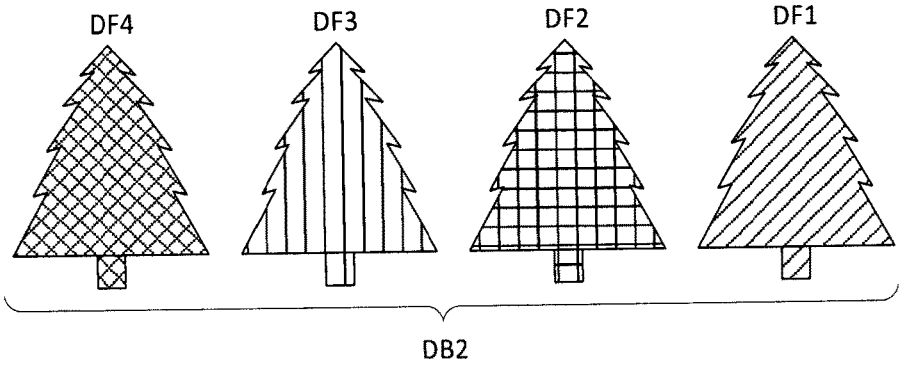
FIG. 3*c* is a schematic representation a plurality of ink layers with different printing inks of a second printing image.

As represented schematically in FIGS. 3*a* to 3*c*, the printing image arrangement 1 is formed by the application of ink layers applied one after another at sequential time intervals. First the printing image DB1 is printed on by the application of one or more printing inks DF1-DF4. Next, the reflection layer RFLX is applied onto the first printing image DB1, and onto this reflection layer the second printing image DB2 is applied with one or more printing inks DF1-DF4. The reflection layer RFLX can in this situation be provided full-surface between the printing images DB1 and DB2. As an alternative, the reflection layer RFLX may be provided only partially, i.e. in part regions between the printing images DB1 and DB2. By a partial application of the reflection layer RFLX between the printing images DB1, DB2, the printing image arrangement 1 can comprise translucent printing image regions (those regions in which no reflection layer RFLX is present) and light-impermeable printing image regions (those regions in which a reflection layer RFLX is present). As a further alternative or in addition, it is possible for the reflection layer RFLX to be configured as not fully covering but permeable/opaque, i.e. for example printed only 50% surface-covering, but distributed over the entire surface occupied by the printing image arrangement 1. In other words, the reflection layer RFLX is present partially covering between the first and second printing images DB1, DB2, i.e. the printing pixels forming the reflection layer RFLX are fewer/smaller, and the reflection layer RFLX therefore appears lighter or partially permeable.

Figure 3D:
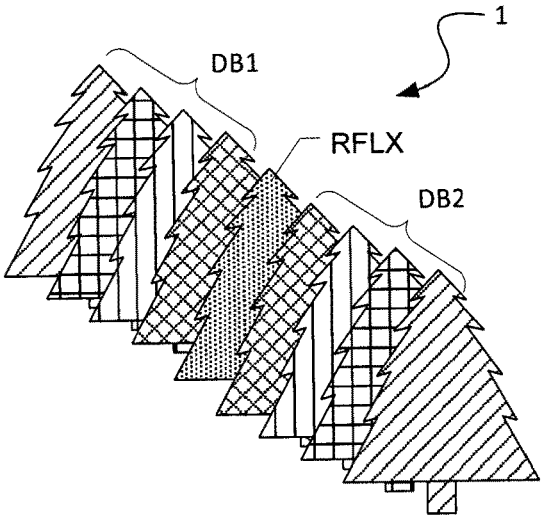
FIG. 3*d* is a schematic representation a printing image arrangement formed by an arrangement of the ink layers from FIGS. 3*a* to 3*c* above one another.

FIG. 3*d* shows a schematic representation of the ink applications layered above one another of the printing image arrangement 1. The reflection layer RFLX is arranged as a separation layer between the first and second printing image DB1, DB2. Preferably, the printing inks DF1-DF4 are arranged mirror-symmetrically relative to the reflection layer RFLX, i.e. same printing inks DF1-DF4 exhibit the same layer interval spacing to the reflection layer RFLX. In other words, the printing inks DF1-DF4 of the printing image DB1 are arranged in the reverse sequence to the printing inks DF1-DF4 of the printing image DB2.

Figure 4:
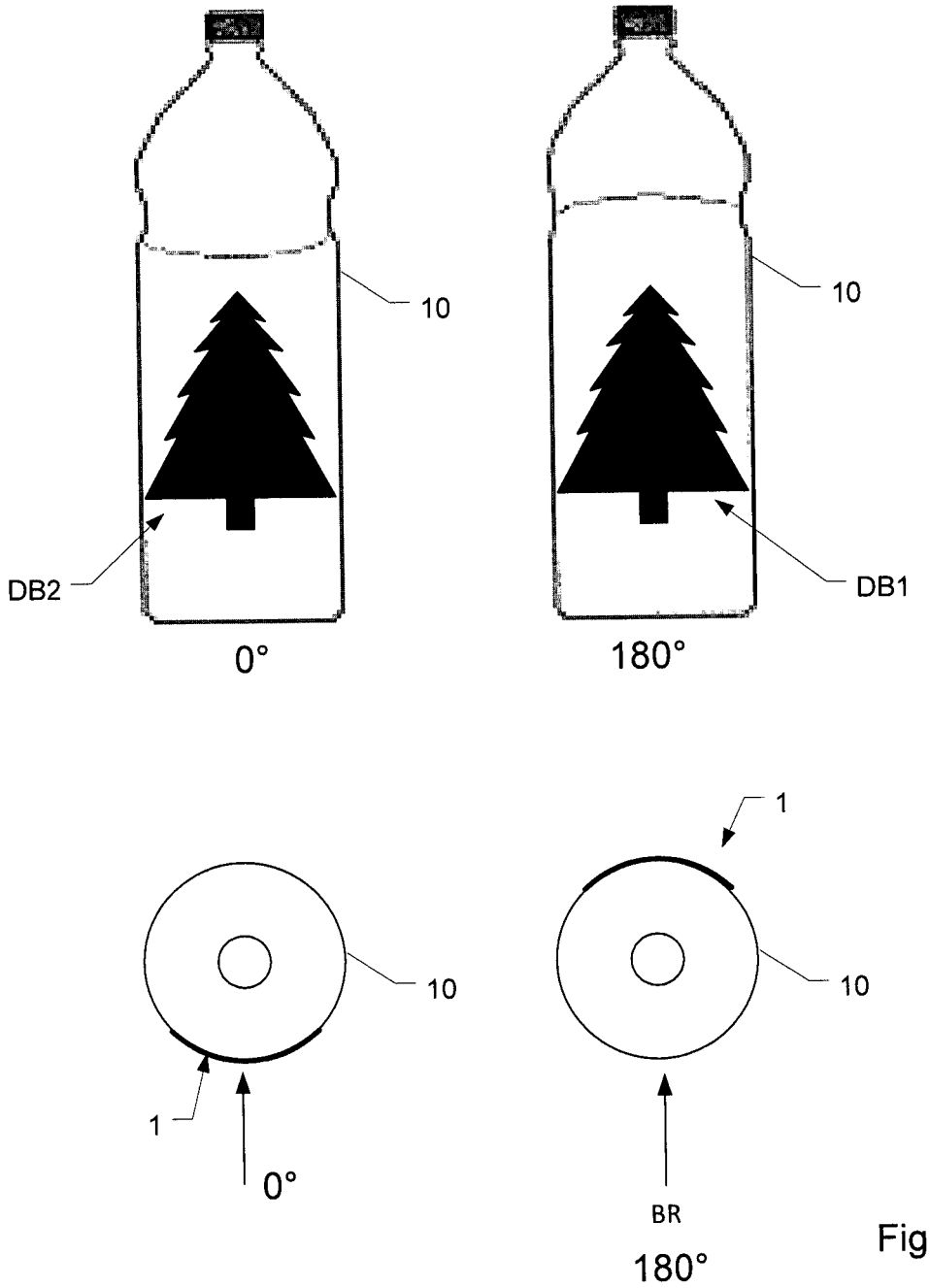
FIG. 4 is a view from above of a plurality of representations of a container printed with a printing image arrangement according to FIG. 3*d*, wherein the upper representation row shows the container in a side view in different rotation positions (left: Front side view; right: Rear side view), and the lower representation row shows the container in the same rotation positions.

FIG. 4 shows, by analogy with FIG. 2, several representations of the container 10, on which a printing image arrangement 1 is provided, described heretofore in connection with FIGS. 3*a* to 3*d* (in each case a side view and view from above, with different orientation alignments of the container 10). The left upper representation in FIG. 4 shows in turn a container 10 in a front side view onto the printing image arrangement 1, and the right upper representation in FIG. 4 shows a container 10 in a side view onto the printing image arrangement 1, i.e. the printing image arrangement 1 is appraised through a first transparent container wall, the container interior, and a second transparent container wall. The representations in the left-hand column in FIG. 4 show the container 10 in a first orientation and the representations in the right-hand column show the container 10 in a second orientation, which is rotated through 180° in relation to the first orientation. As can be seen from the arrows indicating the direction of view BR, the appraisal of the printing image arrangement 1 in the container representations of the right-hand column is from the rear side, through the container walls and a filling product which may be present. The printing image arrangement 1 shown in FIGS. 3*a* to 3*d* allows for the first printing image DB1 to be a printing image which can be appraised independently of the second printing image DB2, and specifically in such a way that the first printing image DB1 can be identified, in a view from the rear side, through the transparent container wall and through the container interior, and the second printing image DB2 can be identified in a front side view onto the container 10. The reflection layer RFLX has the effect that no or essentially no visible light can be transmitted though the printing image arrangement, and therefore the first printing image DB1 is optically separated from the second printing image DB2.

Figure 5A:
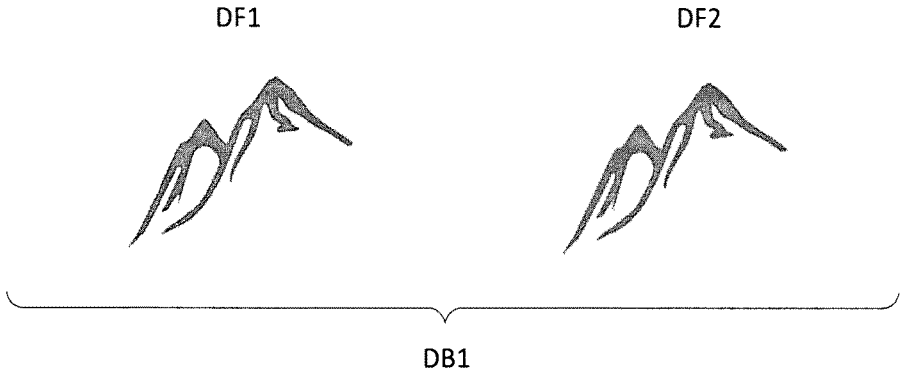
FIG. 5*a* is a schematic representation a plurality of ink layers with different printing inks of a first printing image.
Figure 5B:
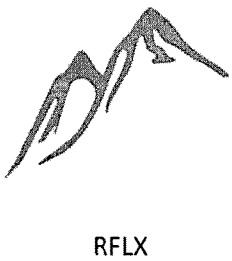
FIG. 5*b* is a schematic representation a reflection layer for the first printing image from FIG. 5*a;*
Figure 5C:
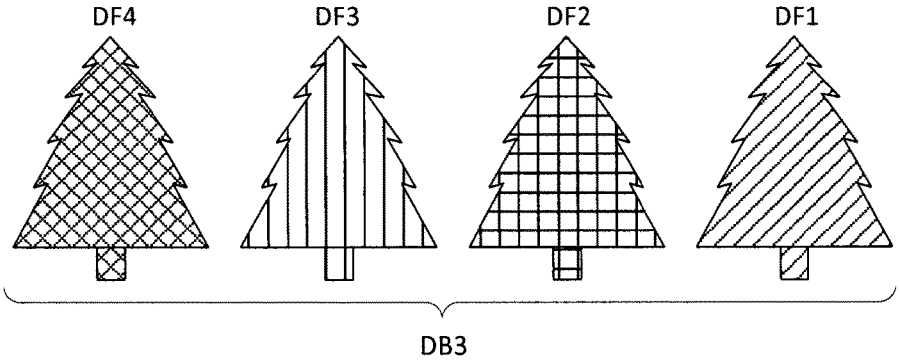
FIG. 5*c* is a schematic representation a plurality of ink layers with different printing inks of a third printing image.
Figure 5D:
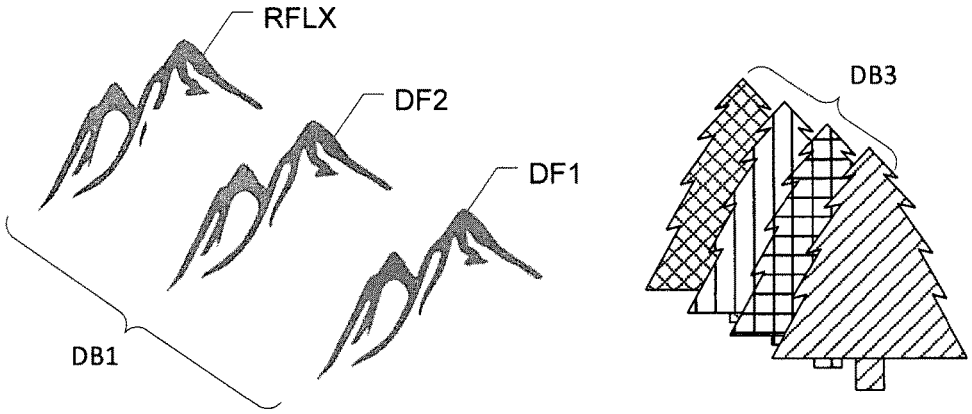
FIG. 5*d* is a schematic representation a first and third printing image, formed by arrangement of the ink layers from FIG. 5*a* and 5*b* or 5*c* respectively, above one another.

FIGS. 5*a* to 5*d* and FIG. 6 show a printing image arrangement on a container 10, which comprises a plurality of printing image arrangement constituent parts on opposing sides of the container 10 (relative to the container height axis) and is configured for this purpose such as to produce, by interaction of the printing image constituents, a spatial printing image. For this purpose, on a first container wall region (0°-position in FIG. 6), a first printing image DB1 is provided, and on a second container wall region, diametrically opposite the first container wall region (180°-position in FIG. 6), a further printing image DB3 is provided. The first printing image DB1 is formed, in the exemplary embodiment shown, by way of example, by a mountain backdrop, and, further by way of example, is formed by overlaying of a plurality of printing inks DF1, DF2. For example, the first printing ink DF1 is applied directly onto the container wall, and the second printing ink DF2 covers at least partially the second printing ink. It is understood that the first printing image DB1 can also be formed from more than two printing inks or only from one single printing ink. Provided on this first printing image is then a reflection layer RFLX (FIG. 5*b*). This reflection layer RFLX can in turn be provided partially, full-surface, or partially surface-covering. It can, for example, be adjusted in form to the first printing image, or it can exhibit an independent form (polygon, rectangle, square, etc.).

In the exemplary embodiment shown, no further printing image is provided on the reflection layer RFLX. It is understood, however, that, as a departure from this, by analogy with the exemplary embodiments described heretofore, a second printing image can be provided on the reflection layer.

Provided on the side opposite the first printing image DB1 is the further printing image DB3, which in turn can consist of a plurality of layers of printing inks DF1-DF4, which at least partially overlay one another.

Figure 6:
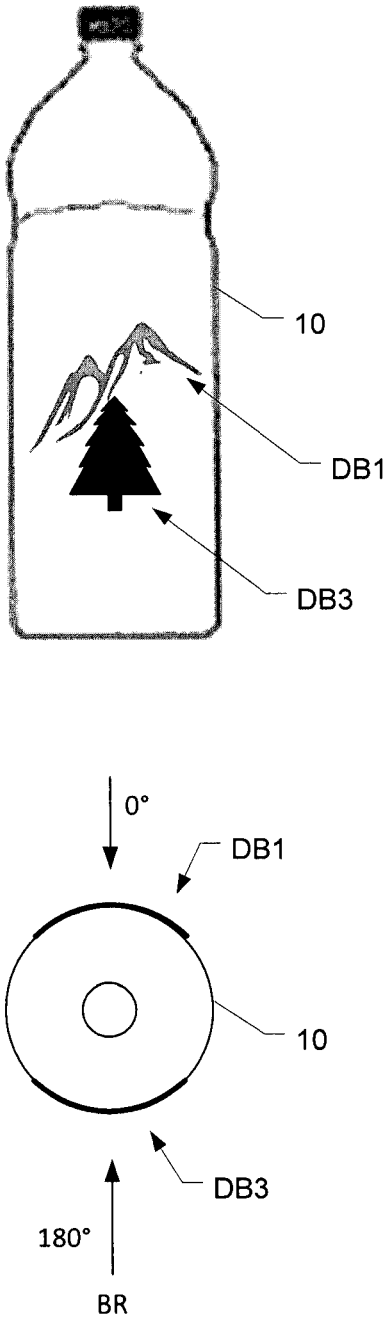
FIG. 6 is a view from above of a plurality of representations of a container printed with the printing images according to FIG. 5*d*, wherein the upper representation shows the container in a side view, with a view onto the container in the direction of view BR, and the lower representation shows the container.

As shown in FIG. 6, when the container is observed in the direction of view BR, an overlaying occurs of the first printing image DB1, provided on the rear side, with the front-side printing image DB3. In other words, the printing image DB1 can be appraised through the container walls and the container interior, and appears, for example, as the background of the printing image DB3. The reflection layer applied onto the first printing image DB1 has the effect in this situation of a background or primer coating, in order to reduce the light permeability of the first printing image DB1, and therefore to render the first printing image clearly perceptible. Likewise, with the further printing image DB3, an ink application can be made between the container wall and the printing image DB3, in order to reduce the light permeability of the printing image DB3. For this purpose, as a rule, the same ink or ink type is used, as with the reflection layer described.

FIGS. 7 to 11 show schematic representations of a plurality of devices 20 for the printing of containers 10, by means of which a printing image arrangement 1 described heretofore can be applied on a container 10. The printing devices 20 comprise in each case a plurality of transport elements 22. Provided on these transport elements 22 are in each case a plurality of print stations 21, at which the printing of the containers 10 takes place in individual temporally sequence printing steps. Provided at the print stations 21 are in each case printing means, for example printing heads operating in accordance with an ink-jet principle, by means of which the respective printing ink DF1-DF4 is applied onto the container wall. Other printing means are also conceivable, such as, for example, printing means for a transfer print. In the exemplary embodiments shown in FIGS. 7 to 11, one printing ink DF1-DF4 is allocated in each case to a transport element 22, i.e. all the print stations 21 of the respective transport element 22 are configured for the application of one single specified printing ink DF1-DF4.

The containers 10 to be printed are fed to the printing devices 20, as indicated by the arrow, by way of a container feed device 23, and then transported on a transport segment with multiple deflections, by means of the transport elements 22, through the printing device 20, to the container discharge 24, wherein, during the transport of the containers 10, the printing takes place. Such a printing device 20 is described, for example, in DE 10 2011 122 912 A1, the contents of which are herein incorporated by reference. During the transporting of the containers 10 by the respective transport elements 22, the printing of these containers takes place in a temporal sequence with ink layers of different printing inks DF1-DF4.

Figure 7:
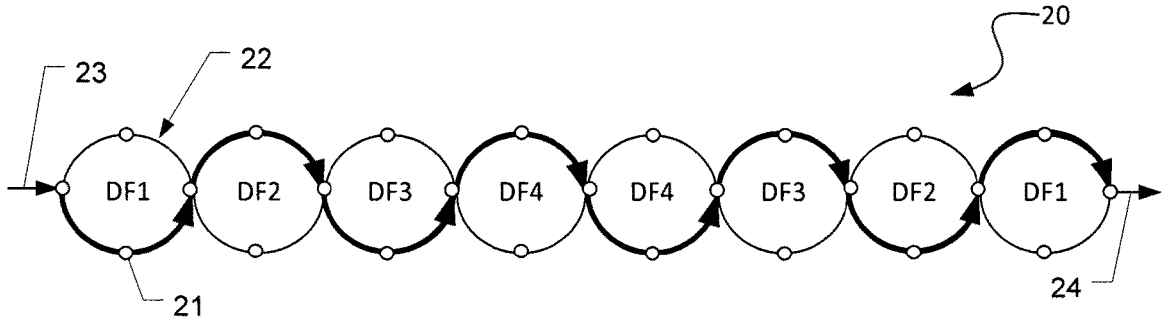
FIG. 7 is a schematic representation viewed from above of a first exemplary embodiment of a printing device for the printing of containers.
Figure 9:
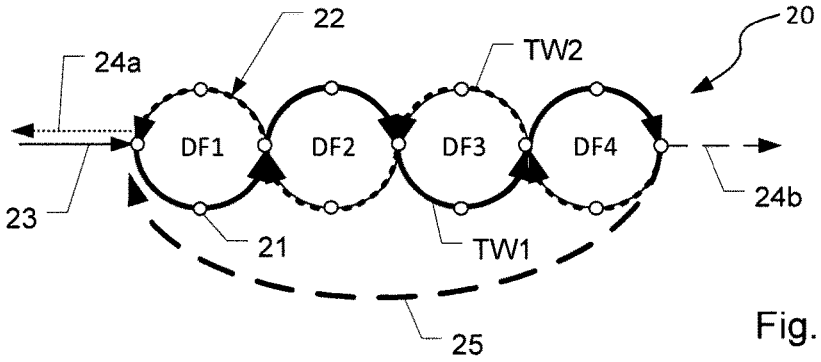
FIG. 9 is a schematic representation viewed from above of a third exemplary embodiment of a printing device for the printing of containers.

The printing devices 20 according to FIGS. 7 and 9 are provided for the applying of a printing image arrangement 1 according to the exemplary embodiment shown in FIGS. 1*a* to 1*a* and FIG. 2, i.e. a printing image arrangement 1 without reflection layer RFLX. Accordingly, for example, the containers 10 are printed on the first transport element 22, following directly on the container feed 23, with the printing ink DF1, on the second transport element 22 following this with the printing ink DF2, and so on. In the exemplary embodiment shown in FIG. 5, in each case two transport elements 22 are provided, which have the effect of printing with the same printing ink DF1-DF4. The arrangement of the transport elements 22, which have the effect of the printing of the containers 10 with a specific printing ink DF1-DF4, is selected in such a way that the printing inks DF1-DF4, as described heretofore, are applied inverted, i.e. first, for example, the printing inks of the printing image DB1 are applied in the sequence DF1, DF2, DF3 and DF4, and then the printing inks of the printing image DB2 in the sequence DF4, DF3, DF2 and DF1. As described heretofore, other printing ink arrangements are possible, for example an arrangement of such a form that the printing inks are arranged only partially inverted (e.g. DB1: DF1, DF2, DF3,DF4 and DB2:DF4, DF3, DF1, DF2.)

The printing device 20 according to FIG. 9 differs from the printing device 20 described heretofore according to FIG. 7 in that, in each case, only one transport element 22 is provided per printing ink DF1-DF4. The printing image DB1 is applied after the container feed 23 to the first transport element 22 in the printing ink sequence DF1, DF2, DF3 and DF4, and specifically on a first transport segment TW1, with multiple deflections, for example in meander fashion. The application of the printing image DB2 onto the container takes place on a return segment TW2, running in the opposite direction and likewise with multiple deflections, for example in meander fashion, to the container discharge 24*a*. The container discharge 24*a* is preferably provided adjacent to the container feed 23. As a result of this, with the use in each case of only one transport element 22 per printing ink DF1-DF4, a doubled application of the respective printing ink DF1-DF4 can take place. As an alternative, it is possible for the container 10, after the application of the printing image DB1, to be conveyed back again by a return transport device 25 to the container feed 23, and thereby the transport segment formed by the transport elements 22 runs twice on the same transport path and is transported away at the container discharge 24*b*. As a result, a non-inverted layered application of the respective printing inks DF1-DF4 is attained.

Figure 8:
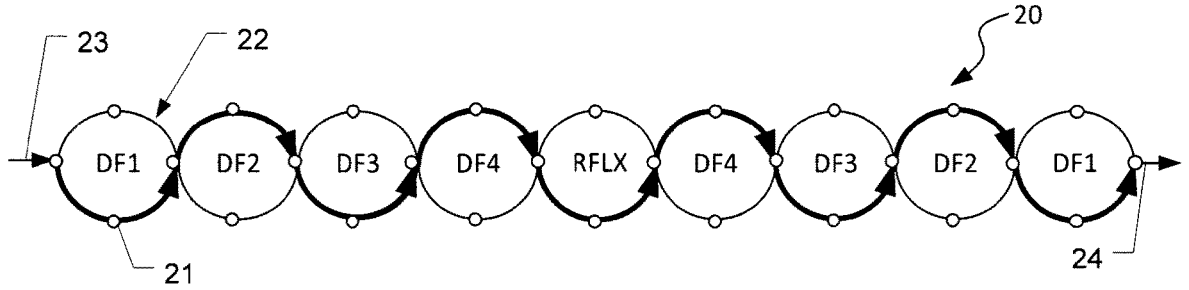
FIG. 8 is a schematic representation viewed from above of a second exemplary embodiment of a printing device for the printing of containers.
Figure 10:
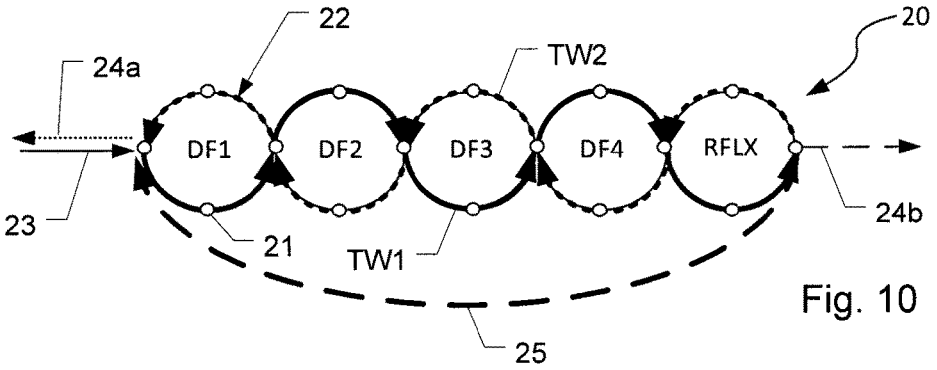
FIG. 10 is a schematic representation viewed from above of a fourth exemplary embodiment of a printing device for the printing of containers.

FIGS. 8 and 10 show printing devices 20, by means of which a printing image arrangement 1 according to FIGS. 3*a* to 3*d* can be produced. The printing device 20 according to FIG. 8 is configured essentially identically to the printing device 20 according to FIG. 7, such that only the differentiation features will be considered. Otherwise, the remarks apply as made in relation to the embodiment according to FIG. 7.

The major difference between the printing device 20 according to FIG. 8 in relation to the printing device 20 according to FIG. 7 is that, in the middle region of the transport path, on which the printing takes place, a transport element 22 is provided, by means of which the reflection layer RFLX is applied. This reflection layer RFLX can be produced, for example, by the application of an ink layer by means of a printing head or other printing methods (such as transfer printing, screen printing, etc.). In greater detail, in a first region of the transport path, by the printing device 20, the first printing image DB1 is printed on, for example by the application of ink layers in the printing ink sequence DF1, DF2, DF3 and DF4, then the reflection layer RFLX is applied onto the first printing image DB1, and on this reflection layer RFLX, in turn, the second printing image DB2 is printed, by the application of ink layers in the printing ink sequence DF4, DF3, DF2 and DF1. Accordingly, the reflection layer RFLX is an intermediate layer between the printing images DB1, DB2.

FIG. 10 shows a further embodiment of a printing device 20 similar to the embodiment according to FIG. 9 described heretofore. The printing device 20 according to FIG. 10 is configured essentially identically to the printing device 20 according to FIG. 9, such that hereafter only the differentiation features will be considered. Otherwise the remarks apply made heretofore in relation to the embodiment according to FIG. 9.

The major difference between the printing device 20 according to FIG. 10 in relation to the printing device 20 according to FIG. 9 is that a further transport element 22 is provided for the application of the reflection layer RFLX. This further transport element 22 is provided in the transport direction after the transport element, by means of which the last printing ink DF1-DF4 is applied, in the exemplary embodiment shown the printing ink DF4 of the first printing image DB1. After the application of the reflection layer RFLX, the containers 10 can either, as described heretofore in reference to FIG. 7, be printed on a return transport segment, running in the opposite direction and likewise with multiple deflections, for example in meander fashion, with the second printing image DB2, or the containers 10 can be conveyed back by means of a suitable return transport device 25 to the container feed 23 and run through the printing device 20 again, on the same transport segment, in order to be provided with the second printing image DB2. In the latter case, it is possible, for example, at the repeat run through on the same transport segment, for the application of the reflection layer RFLX to be deactivated, such that only the printing inks DF1-DF4 are applied onto the container 10, but not the reflection layer RFLX.

Figure 11:
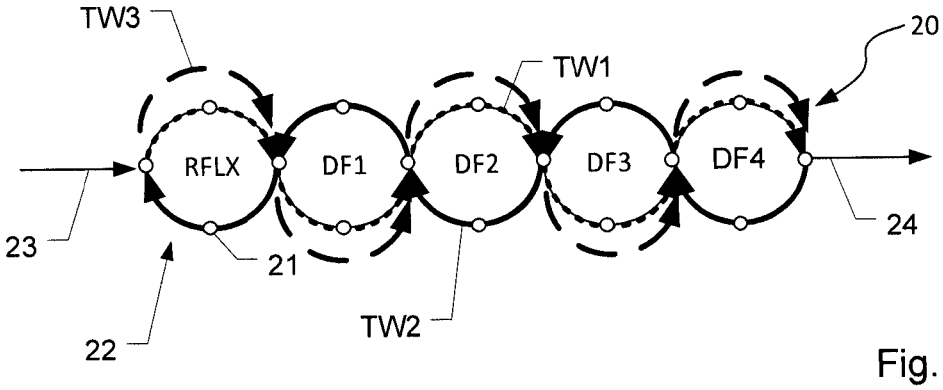
FIG. 11 is a schematic representation viewed from above of a fifth exemplary embodiment of a printing device for the printing of containers.

FIG. 11 shows a further exemplary embodiment of a printing device 20 similar to the representation according to FIG. 10. The printing device 20 according to FIG. 11 differs from the printing device 20 according to FIG. 10 described heretofore in that the transport element 22, which is configured for the application of the reflection layer RFLX, in relation to the container feed 23 forms the first transport element 22 in the chain of the transport elements. Accordingly, the printing device 20 can be used both for the application of an individual standard printing image, which is formed from a primer layer (e.g. ink layer applied by the transport element which is equipped for the application of the reflection layer RFLX) and one or more ink layers (from the set of printing inks DF1-DF4), as well as for the application of a printing image arrangement 1 comprising two superimposed printing images DB1, DB2, with a reflection layer RFLX arranged between them.

In order to apply the standard printing image, the containers 10 run through the printing device 20 in one single run through, and specifically from the container feed 23 over the meander-shaped transport segment TW1, formed by the plurality of transport elements 22, to the container discharge 24, i.e. every transport element 22 is run through one single time.

For the application of a printing image arrangement 1 comprising two superimposed printing images DB1, DB2 with a reflection layer RFLX arranged between them, the printing device 20 is actuated in such a way that the containers 10 are first conveyed, without the application of ink layers, on the transport segment TW1 from the container feed 23 in the direction of the container discharge 24, in order to begin with the container printing at the transport element 22 located closest to the container discharge 24. Next, the containers 10 are transported on the transport segment TW2 back in the direction of the container feed 23, and in this situation are printed with one or more printing inks DF1-DF4. This is followed by the at least partial application of the reflection layer RFLX at the transport element 22 adjacent to the container feed 23. For the application of the second printing image DB2, the containers 10 are then conveyed on the transport segment TW3 in the direction of the container discharge 24, and, after the completion of the second printing image DB2, are transported away through this container discharge 24.

The invention has been described heretofore by way of exemplary embodiments. It is understood that many alterations or derivations are possible, without thereby leaving the inventive concept on which the invention is based.

For example, with regard to the previous exemplary embodiment relating to the printing device 20, it was assumed that printing device comprises a plurality of transport elements 22, which in each case have the effect of applying a certain printing ink DF1-DF4. As an alternative, however, it is possible for the printing device 20 to comprise only one single transport element 22, with several print stations, at which a plurality of print heads are provided for the application of different printing inks DF1-DF4. The printing device can in particular be configured according to an exemplary embodiment described in DE 10 2007 050 490 A1, the contents of which are herein incorporated by reference. Moreover, a print head can be provided at the print stations for the application of the reflection layer RFLX. As a result, the individual ink layers or the reflection layer RFLX respectively can be applied onto the container 10 at one single print station, and specifically, for example, by a relative movement of print heads, in such a way that a first print head is moved out of an active position, and a further print head is moved into this active position.

As a further alternative, the printing device 20 can comprise one single print station, at which different printed heads are provided for the application of the printing inks DF1-DF4 and, for example, also a print head for the application of the reflection layer RFLX. Such a printing device is described, for example, in DE 10 2014 116 405 A1, the contents of which are herein incorporated by reference.

Having described the invention, and a preferred embodiment thereof, what is claimed as new, and secured by Letters Patent is:

1. A process comprising printing on a container, wherein said container is an at least partially transparent container, wherein printing on said container comprises executing first and second printing steps, wherein said first printing step comprises printing a first printing image onto said container by applying at least one printing ink to form a first ink layer that is allocated to said first printing image, wherein said second printing step comprises printing, onto said container, a second printing image that at least partially covers said first printing image, wherein printing said second printing image comprises applying at least one printing ink to form a second ink layer that is allocated to said second printing image, wherein said second printing image at least partially covers said first printing image in such a way that ink layers are applied in a temporal sequence onto said container, and between at least a portion of said first and second printing images, providing a reflection layer, wherein, as a result of said reflection layer, said first and second printing images are at least partially optically separated from one another, wherein said reflection layer is a non-transparent reflection layer and wherein printing said first and second printing images comprises using digital print heads to carry out said digital printing.

2. The process of claim 1, wherein applying at least one printing ink to form a second ink layer comprises applying an ink that differs from ink allocated to said first printing image.

3. The process of claim 2, wherein applying at least one printing ink to form a first ink layer comprises applying a plurality of printing inks according to a first sequence, wherein applying at least one printing ink to form a second ink layer comprises applying said plurality of printing inks according to a second sequence, and wherein said second sequence is said first sequence in reverse.

4. The process of claim 2, wherein applying at least one printing ink to form a first ink layer comprises applying a plurality of printing inks according to a first sequence, wherein applying at least one printing ink to form a second ink layer comprises applying said plurality of printing inks according to a second sequence, and wherein said second sequence is different from said first sequence.

5. The process of claim 2, wherein applying at least one printing ink to form a first ink layer comprises applying a plurality of printing inks and wherein applying at least one printing ink to form a second ink layer comprises applying said plurality of printing inks to form a second printing image that is congruent to said first printing image.

6. The process of claim 1, wherein providing a reflection layer comprises forming said reflection layer by applying a printing ink.

7. The process of claim 1, wherein providing a reflection layer comprises providing a reflection layer that forms a full-surface between said first and second printing images.

8. The process of claim 1, further comprising printing a third printing image onto said container.

9. The process of claim 8, wherein printing a third printing image comprises printing said third printing image on a container wall region that lies opposite said first and second printing images.

10. The process of claim 1, wherein applying at least one printing ink comprises applying a printing ink that contains titanium dioxide.

11. The process of claim 1, wherein applying said reflection layer comprises causing pixels in said reflection layer and pixels in at least one of said first and second printing images to have different sizes.

12. The process of claim 1, wherein applying said reflection layer comprises causing the number of pixels in an area of said reflection layer to differ from the number of pixels in an equal area on at least one of said first and second printing images.

13. The process of claim 1, wherein said reflection layer defines a translucent region.

14. The process of claim 1, further comprising causing said container to traverse a transport segment having multiple deflections between transport elements, wherein the number of transport elements is one greater than the number of inks used in to print the first printing image added to the number of inks used to print the second printing image, wherein said transport elements comprise a first section for printing said first printing image and a second section for printing said second printing image, wherein said second section is downstream from said first section, wherein there exists at least one printing ink that is used in both said first printing image and in said second printing image, wherein a transport element in said first section prints with said at least one printing ink and a transport element in said second section also prints with said at least one printing ink.

15. The process of claim 1, further comprising causing said container to traverse a transport segment having multiple deflections between transport elements, wherein the number of transport elements is one greater than the number of inks used to print said first and second printing images, wherein no two transport elements print using the same printing ink.

16. The process of claim 1, wherein said first printing image comprises two different inks and said second printing image comprises two different inks.

17. The process of claim 1, further comprising causing said reflection layer to expose said first printing image and to conceal said second printing image when said container is viewed from a first direction and causing said reflection layer to expose said second printing image and to conceal said first printing image when said container is viewed from a second direction.

18. The process of claim 1, further comprising causing said reflection layer to conceal said first printing image and said second printing image.

* * * * *